US011534355B2

(12) United States Patent
Rubin et al.

(10) Patent No.: US 11,534,355 B2
(45) Date of Patent: Dec. 27, 2022

(54) FLEXIBLE LEG SUPPORTING MEMBRANE, LEG SUPPORT FRAME AND MOBILE PATIENT STANDING AND RAISING AID

(71) Applicant: Huntleigh Technology Limited, Bedfordshire (GB)

(72) Inventors: Marie Rubin, Barseback (SE); Therese Hellström, Lomma (SE)

(73) Assignee: Huntleigh Technology Limited, Dunstable (GB)

( * ) Notice: Subject to any disclaimer, the term of this patent is extended or adjusted under 35 U.S.C. 154(b) by 19 days.

(21) Appl. No.: 16/616,133

(22) PCT Filed: May 23, 2018

(86) PCT No.: PCT/EP2018/063477
§ 371 (c)(1),
(2) Date: Nov. 22, 2019

(87) PCT Pub. No.: WO2018/215526
PCT Pub. Date: Nov. 29, 2018

(65) Prior Publication Data

US 2020/0078245 A1 Mar. 12, 2020

(30) Foreign Application Priority Data

May 23, 2017 (GB) ..... 1708268

(51) Int. Cl.
*A61G 7/10* (2006.01)

(52) U.S. Cl.
CPC ..... *A61G 7/1096* (2013.01); *A61G 7/1038* (2013.01); *A61G 7/1017* (2013.01);
(Continued)

(58) Field of Classification Search
CPC .. A61G 7/1096; A61G 7/1038; A61G 7/1017; A61G 7/1046; A61G 7/1051;
(Continued)

(56) References Cited

U.S. PATENT DOCUMENTS 4,111,445 A 9/1978 Hailbeck
4,948,156 A * 8/1990 Fortner ..... A61G 5/14 180/907
2016/0184151 A1* 6/2016 Anderberg ..... A61G 7/1051 5/648

FOREIGN PATENT DOCUMENTS

CN 2853051 Y 1/2007
CN 103054674 A 4/2013
(Continued)

OTHER PUBLICATIONS

Office Action issued in CN201880034211.3 dated Nov. 23, 2020.

*Primary Examiner* — David R Hare
*Assistant Examiner* — Madison Emanski
(74) *Attorney, Agent, or Firm* — The Webb Law Firm

(57) ABSTRACT

A flexible supporting membrane is made from a stretchable material formed into a sheet that adjusts itself based on the pressure applied by a patient's knees. The membrane includes: a top edge adapted to be located in a vicinity of the knees of the patient when in use; a bottom edge adapted to be located in a vicinity of the patient's ankles when in use; and a first and second lateral edge extending between the bottom edge and the top edge. The flexible supporting membrane further includes a central section and two peripheral sections extending along the direction defined by the lateral edges between the top edge and the bottom edge of the sheet. The peripheral sections are adapted for each supporting one of the two knees of a patient by yielding to the pressure exerted by the knees and thus forming a knee cradling depression.

15 Claims, 10 Drawing Sheets

(52) U.S. Cl.
CPC ..... *A61G 7/1046* (2013.01); *A61G 7/1051* (2013.01); *Y10S 297/10* (2013.01); *Y10T 442/00* (2015.04)

(58) Field of Classification Search
CPC .. A61G 5/14; A61G 2200/34; A61G 13/1245; A61H 3/04; A61H 2003/005; A61H 2003/0283; A61H 2201/164; A61H 2201/1642; A61H 2201/1645; A61H 2201/1647; A61H 2201/169; A61H 2205/102; A61H 2205/104; A61H 2205/106; A61H 2205/108; A61H 2205/12; A61H 2201/0138; Y10T 442/00; B65H 2401/00; B65H 2401/20; B65H 2401/23; B65H 2401/231; B65H 2401/2311; Y10S 297/04; Y10S 297/10; A63B 2071/0018; A47B 2083/025; A47B 2200/007; A47B 2200/0096; A47B 83/02; A47C 9/002; A47C 7/185
See application file for complete search history.

(56) References Cited

FOREIGN PATENT DOCUMENTS

| | | | | |
|---|---|---|---|---|
| CN | 105101930 | A | 11/2015 | |
| CN | 205144904 | U | 4/2016 | |
| CN | 106214368 | A | 12/2016 | |
| EP | 1142550 | A1 * | 10/2001 | ..... A61G 7/1017 |

* cited by examiner

FLEXIBLE LEG SUPPORTING MEMBRANE, LEG SUPPORT FRAME AND MOBILE PATIENT STANDING AND RAISING AID

CROSS-REFERENCE TO RELATED APPLICATION

This application is the United States national phase of International Application No. PCT/EP2018/063477 filed May 23, 2018, and claims priority to United Kingdom Patent Application No. 1708268.6 filed May 23, 2017, the disclosures of which are hereby incorporated by reference in their entirety.

BACKGROUND OF THE INVENTION

Field of the Disclosure

The present disclosure relates to a flexible supporting membrane that may form part of or may be used with a patient handling device, such as a patient lift, rising aid or standing aid.

Description of Related Art

Mobile standing and raising aids are used in cases where a person with reduced mobility is to be raised from a sitting to a standing position and shortly transferred thereafter, e.g. from bed to wheelchair, or from wheelchair to toilet. Such mobile standing and raising aids are mostly used in hospitals, nursing homes or other health care facilities.

Various types of mobile standing and raising aids are known. Examples include harnesses and sit-to-stand supports. Such mobile standing and raising aids usually include wheels to facilitate convenient approaching of the aid to a bed.

In order to provide aids with high stability and robustness, they are made of rigid, hard and nonflexible materials that may cause discomfort, abrasions, skin tears or bruising.

In particular, such aids also typically include a foot support and knee pads that help guide the patient to the appropriate starting position and help keep the patient's legs properly aligned during the sit-to-stand movement.

As the patient rises to a standing position, the knees, shins or ankles press against the support pads to assist the patient in rising. Often significant pressure is applied by the patient's knees, shins or ankles on the pads. Thus, such pads are typically constructed from metal plates covered in foam or soft plastic. The hard support material of these leg or knee pads, however, focuses stress on the knees and knee caps and can be uncomfortable despite the soft covering.

US 2016/0184151 A1 describes an improved leg support aiming to overcome these drawbacks and comprising a flexible membrane made of a stretchable material that may be attached removably to a stand assist lift. FIGS. 1 to 3 of this application illustrate support 10 comprising a membrane 18 configured as a leg support, for use in supporting the knees of a patient 12, and particularly for assisting the patient 12 to rise from a sitting to a standing position.

While an improvement on the prior art, this reference does not contemplate a design that customizes and allows for independent flexibility of each of a patient's knees. In particular, there is a need to create a supporting membrane in which a natural distance is maintained between the knees and lower legs to avoid knee collapse or knee buckling in which the knees slide together, resulting in stability loss, pain or injury during the raising motion. Such collapse and buckling can be uncomfortable for the patient, preventing them from participating in the raising movement and the up and outward pushing with their legs. Moreover, if the patient's legs become weak from such collapse or buckling there is a risk of sliding downward from the foot support.

SUMMARY OF THE DISCLOSURE

It is therefore an object of the present disclosure to improve the design of a flexible membrane to ensure a secure and adequate positioning and support of the patient's lower legs during the sit-to-stand movement.

The improved flexible supporting membrane may allow the patient to actively participate in the upraising movement in a more natural, less painful and safe way.

The present application solves these problems by providing a flexible supporting membrane, leg strap and/or patient handling device as described herein.

In accordance with an exemplary embodiment of the present disclosure, there is provided a flexible supporting membrane with a multi-sectional construction, comprising a central section being placed between two peripheral sections, wherein said central section exhibits a higher stiffness than the two adjacent peripheral sections. Such specific membrane design with a central separating section enables the patient's legs to be supported separately and independently of each other during a sit-to-stand movement.

According to an exemplary embodiment of the present disclosure, the material of the peripheral sections is sufficiently elastic to conform to and support the contacting portion of a patient's knees and his lower legs during the raising movement. In the knee area of the peripheral sections, where the highest pressing force is applied to the membrane, a knee cradling depression is formed. These convexities progress along the direction of the applied force to finally accommodate the entire lower leg of a patient being lifted. While the low elastic modulus of the membrane in the peripheral sections enables for each patient's knee and the respective lower leg to be entirely or substantially accommodated in knee cradling depressions, the higher elastic modulus of the membrane in the central section ensures that this zone stays essentially or substantially taunt, straight and/or unstretched. In this manner, not only a sliding of the knees towards each other and a resulting knee-to-knee contact can be sufficiently prevented, but also the natural distance between the patient's legs will be established and remain during the sit-to-stand movement, when the patient retracts or straightens his legs. This specific sectional arrangement together with the varying stretching properties of the flexible supporting membrane across its width enables comfortable positioning and support of the patient's legs.

Exemplary embodiments of the flexible supporting membrane are described in the claims and throughout the disclosure.

The disclosure also pertains to a leg support frame, with special embodiments, to a mobile patient standing and raising aid, to a leg strap, and to a method.

BRIEF DESCRIPTION OF THE DRAWINGS

The present disclosure will be described hereafter with reference to the attached drawings which are given as non-limiting examples only, in which.

DETAILED DESCRIPTION OF THE DRAWINGS

Figure 1:
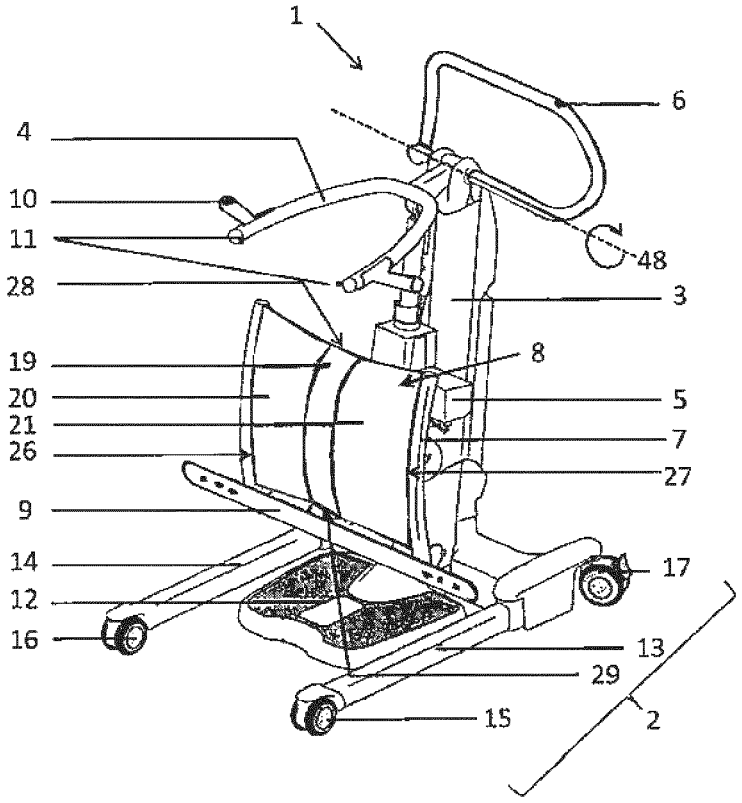
FIG. 1 shows a perspective view of an exemplary mobile standing and raising aid comprising a flexible supporting membrane configured to support patient's knees and lower legs according to one embodiment of the present disclosure.

For purposes of the description hereinafter, the terms "upper", "lower", "right", "left", "vertical", "horizontal", "top", "bottom", "lateral", "longitudinal", and derivatives thereof, shall relate to the orientation in the figures. However, it is to be understood that the invention may assume alternative variations and step sequences, except where expressly specified to the contrary. It is also to be understood that the specific systems and processes illustrated in the attached drawings, and described in the following specification, are simply exemplary examples of the invention. Hence, specific dimensions and other physical characteristics related to the examples disclosed herein are not to be considered as limiting.

The present disclosure is directed to a positioning system for orienting and/or supporting a person's knees and lower legs when moving between siting to standing positions. In one exemplary embodiment, the positioning system includes a flexible membrane that can be used to position and support patient's knees and lower legs during movement to a standing position using, e.g. a mobile standing and raising aid. This leg supporting membrane is not only stretchable but also designed to have sufficient load bearing properties to carry a patient's body weight, such as up to 200 kg in one embodiment.

Optionally, the positioning system may further include a strap that may be configured and oriented to secure and position a patient's lower legs relative to the knee rest. In another exemplary embodiment, the positioning system includes an ankle strap for securing and/or positioning a person's lower legs. Optionally, the ankle strap may be operatively associated with a knee rest so as to securely position a person's knees against a knee rest. The positioning system may be part of a patient handling device, such as but not limited to a raising aid, standing aid or patient lift. In an exemplary embodiment, the present disclosure is directed to a patient handling device for facilitating patient lifting, standing, rising and/or transport, wherein the device includes a mast, lifting arm and knee rest. In an exemplary embodiment, lifting arm and/or knee rest are positioned and arranged to induce a natural sit to stand patient movement.

The flexible membrane of the present disclosure may be made of a singular material or may have a multi-layer and/or multi-component construction, which structure is at least partially stretchable. It is envisaged that in most embodiments the membrane will stretch only a given amount in selected sections under a given load and will remain flexible beyond such load. Moreover, in one embodiment, the present membrane is made of a tear-resistant material to retain its function even after contact with sharp objects.

In an exemplary embodiment, the membrane has a sufficient thickness, tensile strength and an appropriate modulus of elasticity to stretch, when a force is applied by patient's knees and legs during a movement from a sitting to a standing position, without permanently deforming the membrane.

The present leg support membrane may be part of a patient handling device, such as a mobile standing and raising aid intended to assist caregivers in hospitals, nursing homes, assisted living and group homes and home care facilities to lift and transfer patients/residents from one place to another e.g. to and/or from a chair, wheelchair, bed side, bath, shower/commode chair or toilet.

One such mobile standing and raising aid configured to support a patient's knees and lower legs according to one exemplary embodiment of the present disclosure is shown in FIG. 1. The mobile standing and raising aid is generally identified by reference numeral 1 and comprises a base 2, a mast 3 that extends upwardly from the base 2, a lifting arm 4 pivotally coupled to the mast 3 as well as an actuator 5 and a maneuvering handle 6, which are also attached to the mast 3.

Moreover, FIG. 1 illustrates a leg support frame 7 to which a flexible supporting membrane 8 and a lower leg strap 9 are connected. The leg support frame 7 extends from and is attached to the mast 3 and is positioned beneath the lifting arm 4 in close proximity to a footplate 12.

The base 2 illustrated in FIG. 1 includes the horizontal footplate 12 for proper positioning of the patient's feet, which is located between two adjustable chassis legs 13 and 14, and two pairs of castors, namely two front castors 15 and 16 and two rearwardly arranged castors 17 and 18 (castor 18 can be seen in FIGS. 7, 9, 11 and 12) that facilitate moving the aid 1.

In addition, said castors 15-18 may be equipped with brakes for securing the raising and standing aid 1 during the patient's lifting procedure. By operating the appropriate button on a control panel of the aid or a hand control 44, the adjustable chassis legs 13 and 14 can be opened to any variable width for secure approaching and positioning the footplate 12 in close proximity of the patient's feet prior to the lifting step.

The maneuvering handle 6 enables a caregiver to pull the aid 1, and thus to transfer the upraised patient.

The actuator 5 is used to drive the lifting arm 4 on an arc track of max, 90° from a lowered to a raised position of the aid 1. As shown in FIGS. 1 and 7-9, the lowered position of the aid 1 is configured in such a manner that a person sitting e.g. on a bed or a chair can reach handles 10 of the lifting arm 4.

Components of the mobile standing and raising aid 1, such as the base 2, mast 3, lifting arm 4, chassis legs 13 and 14 or handles 6 and 10 may be formed from conventional robust and rigid materials, such as metal, steel or aluminum, to provide for high structural strength.

In an exemplary embodiment, the lifting arm 4 and/or flexible supporting membrane 8 are arranged to facilitate raising a patient from a seated to standing position. In one embodiment, the lifting arm 4 rotates about mast 3 at a pivot point that is may be positioned adjacent to the supporting membrane 8. In one embodiment, the pivot point of the lifting arm 4 is about 933 mm (+/−1.00), in particular in the range of 920 mm to 940 mm, above the foot plate 12 or base 2. In another embodiment, the upper end of the flexible member 8 is about 622 mm (+/−1.00), in particular in the exemplary range of about 610 mm to about 630 mm, above the foot plate 12 or base 2. In one embodiment, the lifting arm 4 may have a length of about 510 mm (+/−1.00), in particular in the exemplary range of about 500 mm to about 520 mm, extending from mast 3 and/or the pivot point of lifting arm 4. In one embodiment, the ratio of the height of the pivot point from foot plate 12 and/or base 2 to the length of the lifting arm is about 23:1 to about L5:1. In one embodiment, the distance of the pivot point relative to foot plate 12 and/or base 2 can be about 933 mm (+/−1.00). In one embodiment, the distance of the upper distal end of the flexible supporting membrane 8 relative to foot plate 12 and/or base 2 can be about 622 mm (+/−1.00), in particular in the exemplary range between about 600 mm and about 650 mm. In one embodiment, the length of lifting arm 4 extending from mast 3 and/or the pivot point may be about 510 mm (+/−1.00). In one embodiment, the distance of the leg supporting membrane 8 from the mast 3 can be about 280 mm (+/−1.00). In one embodiment, the relative length or distance by which lifting arm 4 and flexible supporting membrane 8 project from mast 3 may be about 2.5:1 to about 1.5:1 or about 2:1 to about 1.75:1. In one exemplary embodiment, the relative proportions and/or the relative positioning of the lift arm, pivot point, flexible supporting membrane 8 may be arranged to facilities the natural movement and positioning of a patient from a seated to standing position.

The lifting arm 4 further includes a pair of sling attachment points 11. These attachment points 11 may be disposed at the end of the two branches or arm members of the lifting arm 4 for receiving and/or securing attachment loops, straps or fasteners of a sling 40, which is configured to wrap around a portion of a patient, e.g. around the back of a patient's upper body, in order to provide back-support during the lifting process of FIG. 6.

Figure 2:
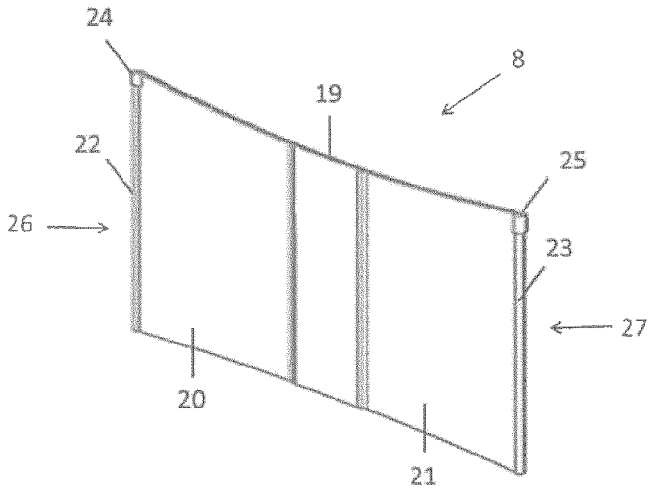
FIG. 2 shows a perspective view of the flexible supporting membrane of the mobile standing and raising aid of FIG. 1.
Figure 3:
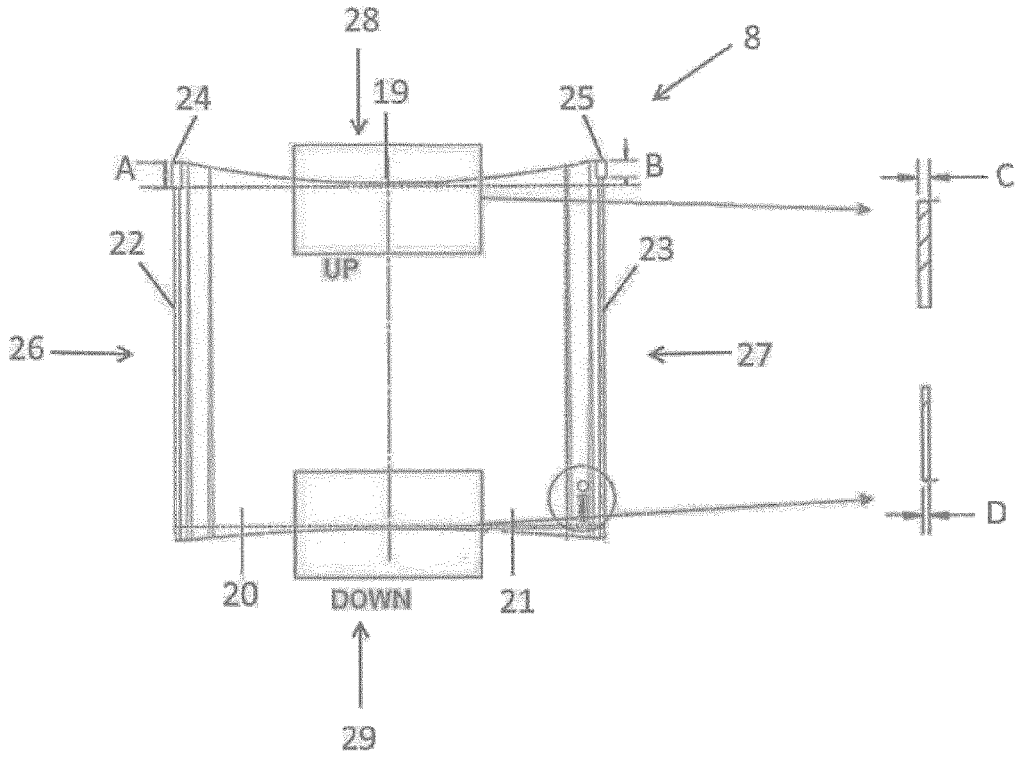
FIG. 3 shows an enlarged frontal view of the flexible supporting membrane of FIG. 2.

Referring to FIGS. 2 and 3, these show an exemplary embodiment of the flexible supporting membrane 8 configured as a leg support, for use in positioning and supporting the knees and lower legs of a patient and particularly for assisting the patient to rise from a sitting to a standing position using a lifter.

FIG. 2 illustrates the sectional arrangement of the flexible supporting membrane 8. This membrane 8 includes a central section 19 and two peripheral sections 20 and 21, which are located adjacent to the central section 19 on its right and left side, respectively. The peripheral sections 20, 21 are designed to flex, support and conform to each one of the patient's legs by yielding to the pressure exerted by the knees against supporting membrane 8 when a patient moves between seated and standing positions. The sections 20 and 21 are sufficiently flexible to form a knee cradling depression. By contrast, the central section 19 is designed to be stiffer and less stretchable than the two adjacent peripheral sections 20, 21. Due to this structural design, the central section 19 functions as a natural border between the patient's knees. It keeps them separated from each other and exactly positioned in their respective depression of the flexed membrane 8 during use of the aid 1.

This structure also enables left and right peripheral sections 20 and 21 to stretch and flex independent of one another to provide specific customized support for each of a patient's knees and legs. In one embodiment, each of sections 20 and 21 has a varying modulus of elasticity of about 9.50 N/mm$^2$, in particular in the range from about 9 N/mm$^2$ to about 10 N/mm$^2$. The membrane material may have a hardness shore A of 60 or about 60, and/or a density of about 1.16 g/cm$^3$, and/or a tear strength of about 48 N/mm.

In one embodiment, left and right peripheral sections 20 may provide greater resistance to flexibility and/or durometer at their respective upper portion than their respective lower portions.

In one embodiment, sections 20 and 21 taper in thickness along its body such that an upper portion of sections 20 and 21 have a maximum thickness at its upper end that tapers to a lesser thickness at a lower portion or lower end of sections 20 and 21.

In an exemplary embodiment, the elastic modulus and thickness of the upper portion of sections 20 and 21 may be about 9.50 N/mm$^2$, in particular in the exemplary range from about 9 N/mm$^2$ to about 10 N/mm$^2$ (elastic modulus), and about 2.00 mm (+/−0.25) to about 197 mm (+/−0.25) (thickness) respectively. In an exemplary embodiment, the elastic modulus and thickness of the lower portions of sections 20 and 21 may be about 9.50 N/mm$^2$, in particular in the exemplary range from about 9 to about 10 N/mm$^2$, and about 2.00 mm (+/−0.25) to about 230 mm (+/−0.25), or between about 1.8 mm and about 2.5 mm, respectively.

In an exemplary embodiment, section 19 of membrane 8 may also have a variable or a uniform elastic modulus and thickness over a range of about 930 N/mm$^2$, in particular in the exemplary range from about 9 to about 10 N/mm$^2$, and about 6.87 mm (+/−0.25) to about 5.07 mm (+/−0.25) extending from a upper end to a lower end of section 19 respectively. In one embodiment, the ratio of elastic modulus of sections 20, 21 relative to section 19 may be about 1 or less.

In one embodiment, the elastic modulus and the degree of elongation or stretch of the upper portion of sections 21, 20 relative to the lower portion of sections 20, 21 and 19 can be about 1:1.25 to about 1:3; about 1:1.5 to about 1:2; or about 1:1.75 to about 1:2.

In one embodiment, the material used for all sections of the flexible member 8, 19-21 as well as for the leg strap 9 may be the same. In one embodiment, flexible member 8, 19-21 and leg strap 9 are constructed from an elastomeric material, such as silicone. The change in elongation/elastic modulus can be achieved by varying the thickness of the various sections of the flexible member 8, including the upper and lower portions 28, 29. The ankle strap thickness may be about 4 mm+/−0.5 mm and elastic modulus may be about 9.50 N/mm$^2$.

Furthermore, FIG. 3 shows an enlarged frontal view of the exemplary flexible supporting membrane 8, comprising: a top edge 28, adapted to be located in vicinity of the knees of the patient when in use; a bottom edge 29, adapted to be located in vicinity of the patient's calves and/or ankles when in use; and first and second lateral edges 26 and 27, extending between the bottom edge 29 and the top edge 28.

In one embodiment of the present disclosure, the membrane 8 is provided in a sheet form and has a rectangular configuration. The sections 19-21 of the flexible supporting membrane 8 may also have rectangular configurations. In addition, the peripheral sections 20 and 21 of the membrane 8 may be designed to have a width and length that is sufficient to accommodate knees and entire shins of a wide range of differently sized patients.

The membrane 8 can be formed of an elastomeric material, such as silicone, or similar materials providing a certain amount of friction, which can help in preventing slippage of the patient during the sit-to-stand movement. Moreover, the flexible nature of the supporting membrane 8 can enable the support to be used by different patients without having to make any adjustments, given that the membrane will stretch less or more in dependence upon the force applied to it. Such type of material can be contoured to the shape of the body and do so significantly better than stiff fabrics that irritate skin or hard plastics unable to flex against a patient's knees.

In some embodiments of the disclosure, the sections 19-21 of the membrane 8 may be provided with visual indicators, such as specific colors, elements or transparency grades, for the purpose of intuitively distinguishing between the central section 19 and the adjacent peripheral sections 20, 21, in order to simplify the positioning of the patient's legs with respect to the membrane 8.

The membrane 8 of FIGS. 2 and 3 further comprises a first and a second lateral support element 22, 23, which are integral with, form part of and/or are otherwise attached or coupled to a first and a second lateral edge 26, 27 of the membrane 8, respectively.

As shown in FIGS. 2 and 3, the lateral support elements 22, 23 may each comprise a first and second stopper 24, 25, which may, for example, be located at the top of the support elements 22, 23, respectively for securing lateral support elements 22, 23 to leg support frame 7. In one embodiment, stoppers 24, 25 may have a radially projecting configuration having a greater width, diameter or profile than corresponding attachment portions of leg support frame 7 as shown in FIGS. 2 and 3. The stoppers 24, 25 function to secure the pre-set position of the membrane 8 in the leg support frame 7 attached to the aid 1 during the patient's raising procedure.

The lateral support elements 22, 23 act as connecting means providing intermediate elements for attaching membrane 8 to the leg support frame 7 of the mobile standing and raising aid 1 shown in FIG. 1.

In one embodiment, lateral support elements 22, 23 and corresponding coupling elements of leg support frame 7 may have a curved configuration, concave with respect to the mast 3. In an exemplary embodiment, lateral support elements 22, 23 and corresponding coupling elements of leg support frame 7 have an arcuate configuration wherein the radius of the aluminum extrusion is about 760.50 mm (+/−0.25) and may be in the exemplary range between about 750 mm and about 770 mm. Once the flexible supporting member 8 is coupled to leg support frame 7, the flexible supporting member 8 is drawn taunt and has the same concave, curved configuration as that of leg support frame 7. In one embodiment, the flexible supporting member 8 is preconditioned to have a curved, concave configuration as that of leg support frame 7 prior to coupling with leg support frame 7. In another embodiment, the curved, concave configuration of flexible supporting member 8 is formed by frame 7 and achieved after member 8 is coupled to similarly configured leg support frame 7. In one embodiment, frame 7 is connected to mast 3 via a transverse mounting bar extending from mast 3 to frame 7. The mounting bar may be spaced apart from membrane 8 to enable a patient's knees to freely flex against sections 20, 21 without obstruction by the mounting bar or other membrane 8 supporting member. In an exemplary embodiment, mounting bar is spaced apart from membrane 8 by a distance of at least about 50 mm to about 100 mm, about 25 mm to about 75 mm or about 50 mm to about 150 mm.

The lateral support elements 22, 23 may be configured as bars, struts, rods or similar elements, and the stoppers 24, 25 may have a cylindrical shape or configuration with e.g. a square, round or elliptical cross-sections.

In some embodiments, the first stopper 24 of the first lateral element 22 may have a different geometry, such as height, width or radius, than the second stopper 25 of the second lateral element 23. The different stopper geometries on the two lateral sides of the membrane 8 act as an indicator of correct placement and/or coupling during insertion of the flexible membrane into the leg support frame 7 to ensure that the membrane 8 is inserted into the leg support frame 7 with the right orientation.

In one special embodiment presented in FIG. 3, the first stopper 24 of the first lateral element 22 has a height of 30 mm (A), while the second stopper 25 of the second lateral element 23 has a height of 20 mm (B).

The flexible supporting membrane 8 may be positioned between and directly connected to the lateral support elements 22, 23 such that the membrane 8 is held taut, under tension, when inserted into the leg support frame 7.

In one exemplary embodiment of the present disclosure, the distance between the lateral support elements 22, 23 (center-to-center frame distance) equals approximately 520 mm (+/−1.5 mm), while the silicone membrane 8 has a width of about 490 mm (+/−2.46), so that a 30 mm pre-stretch is applied to the flexible membrane 8 attached to the leg support frame 7, in order to keep the flexible material straight.

In addition, the membrane 8 of FIG. 3 has a varying thickness uniformly tapering from the thicker top edge 28 to the thinner bottom edge 29. In other words, the thickness changes along the direction defined by the lateral support elements 22, 23, which is the vertical direction, when the membrane 8 is mounted to the leg support frame 7. Accordingly, the shown membrane 8 exhibits the highest thickness in the knee area and the lowest one in the shin contact zone, where the skin is more sensitive.

Figure 6:
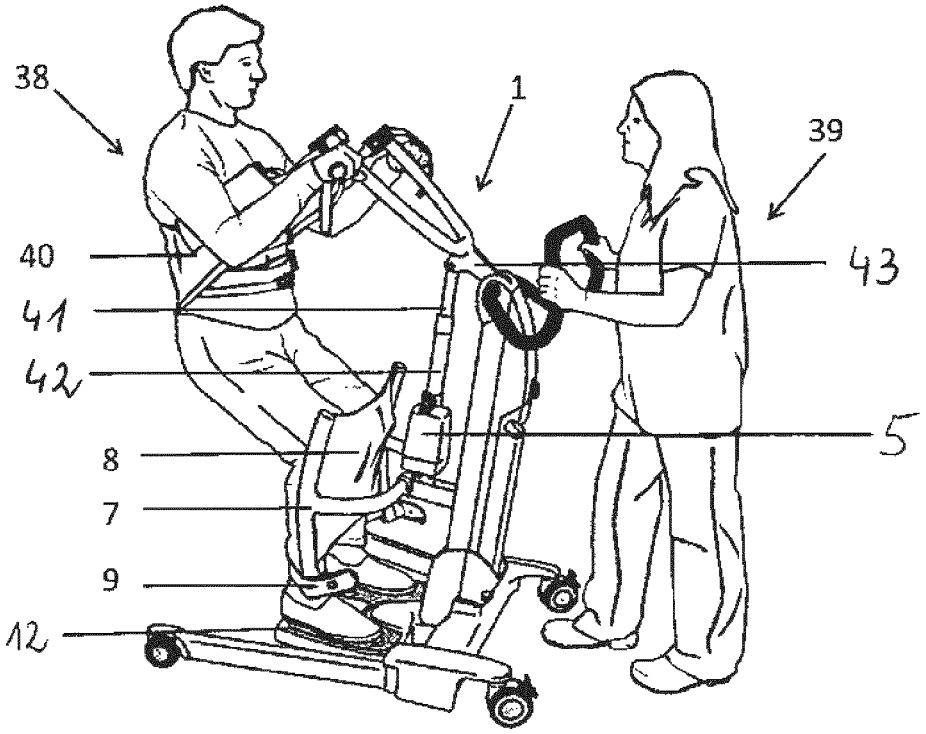
FIG. 6 is a perspective view showing the position of the patient's knees and lower legs with respect to the flexible supporting membrane during a sit-to-stand movement using the mobile standing and raising aid of FIG. 1.
Figure 7:
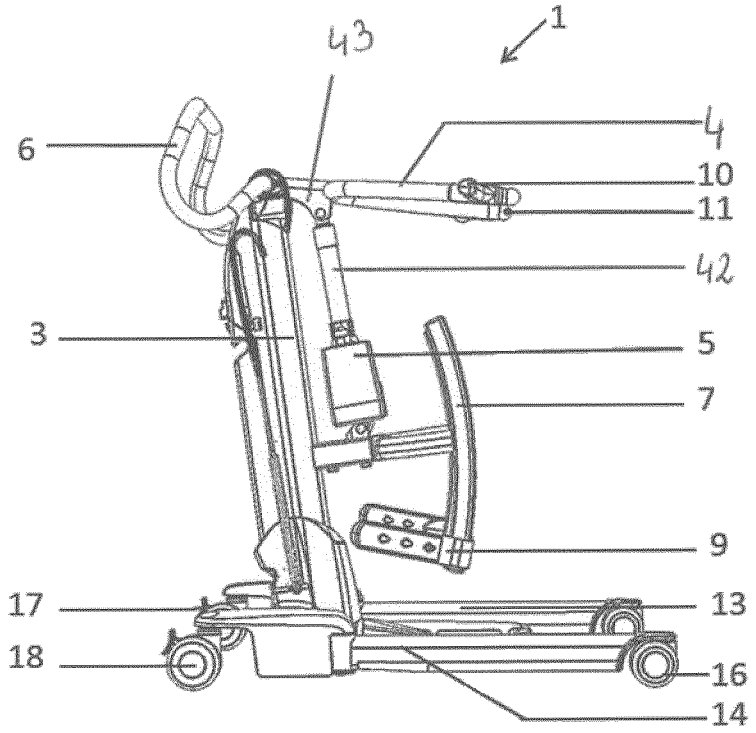
FIGS. 7 and 8 show a first and a second lateral view (right and left) of the mobile standing and raising aid of FIG. 1.
Figure 8:
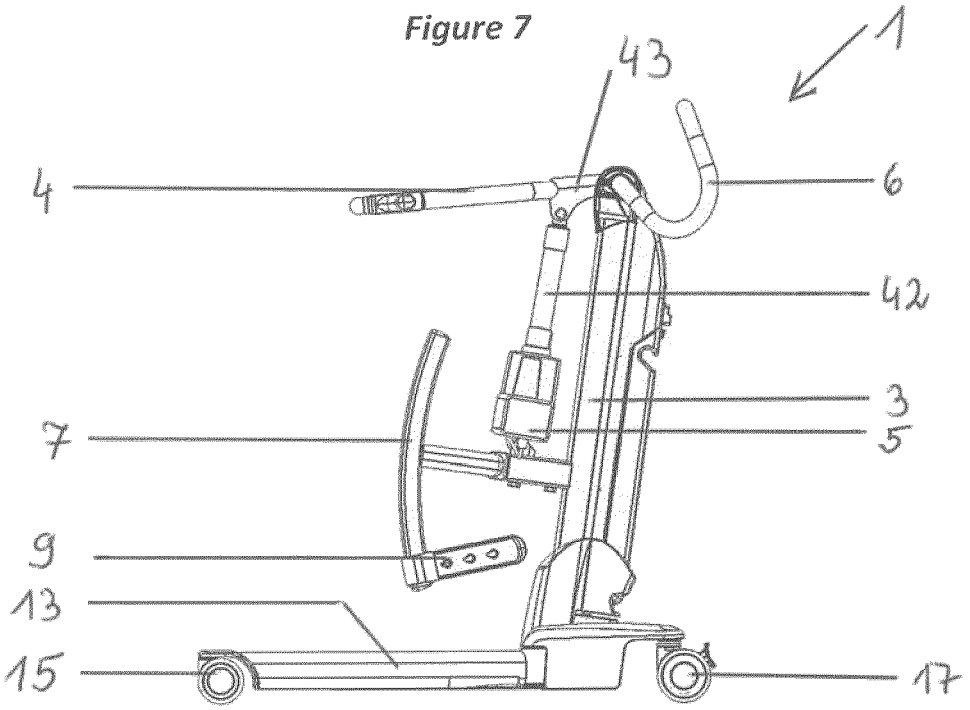
Figure 9:
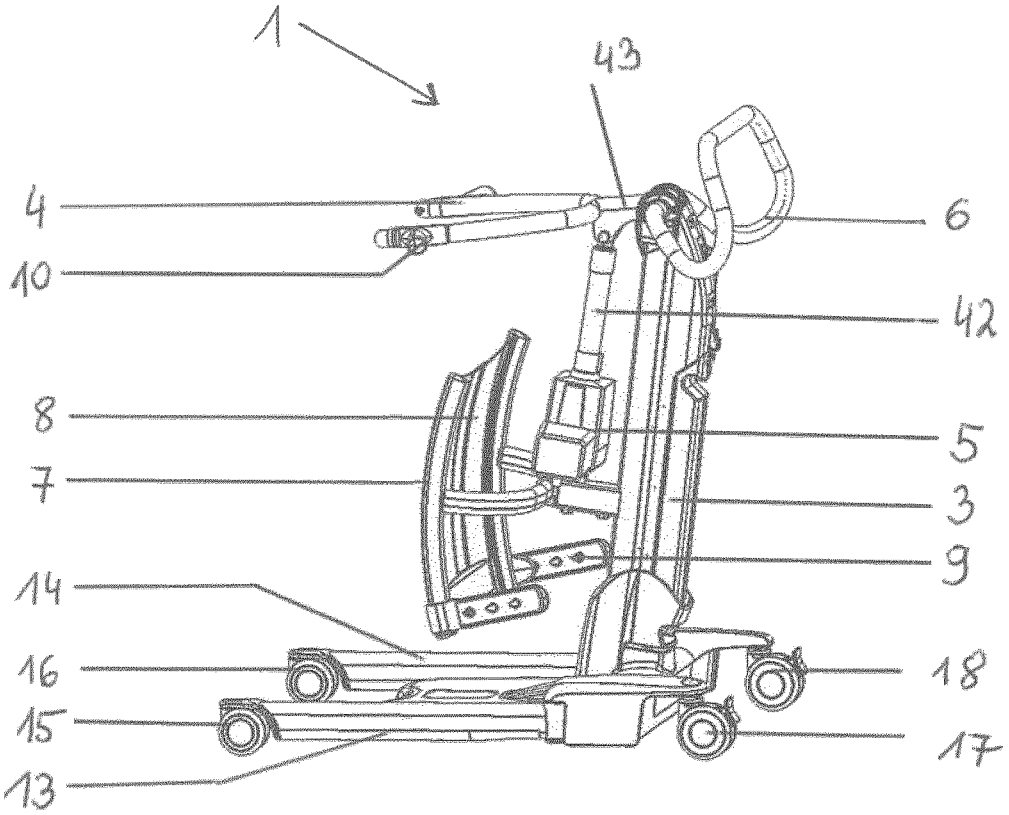
FIG. 9 shows a perspective view of the mobile standing and raising aid of FIGS. 1, 7 and 8.

In other embodiments, the stretchable membrane 8 may be provided with structural reinforcements, such as zones of thicker material or several layers, e.g. in the central section and in the vicinity of the top edge 28 of the peripheral sections 20, 21, where patient's knees are intended to press against the membrane as shown in FIG. 6.

In an exemplary embodiment of the present disclosure, the top edge 28 of the membrane 8 has a thickness "C" of 3.97 mm, whereas the bottom edge 29 has a thickness "D" of 2.00 mm (FIG. 3).

Figure 4:
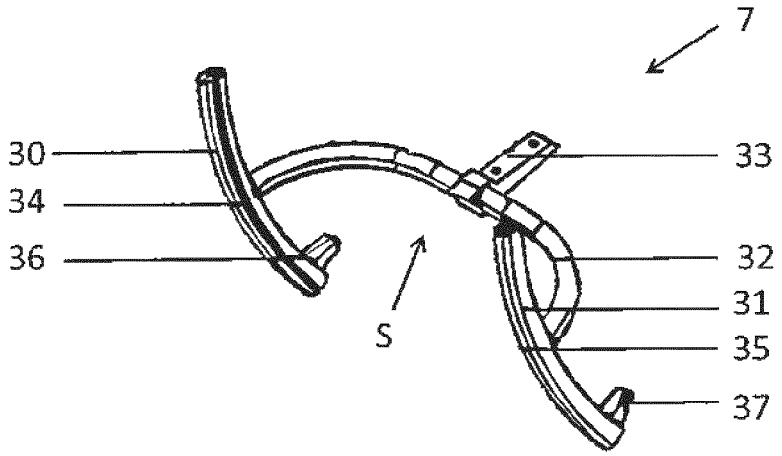
FIG. 4 shows a perspective view of the leg support frame configured to hold the flexible supporting membrane of FIGS. 2 and 3.
Figure 5:
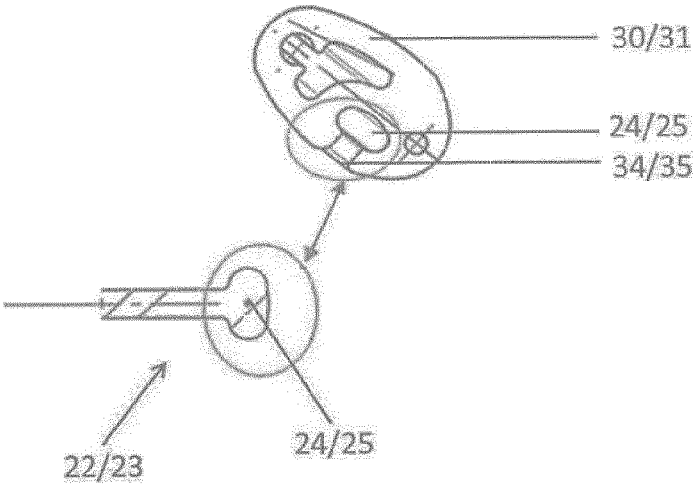
FIG. 5 is a cross-sectional view of a lateral holding fixture of the leg support frame of FIG. 4, showing a lateral support element of the flexible supporting membrane inserted into a slot within said lateral holding fixture. Moreover, shown is an enlarged side view elucidating the geometry of the lateral support element.

FIG. 4 shows a perspective view of an exemplary leg support frame 7 configured to attach the flexible supporting membrane 8 of FIGS. 2 and 3 to the mobile standing and raising aid 1 of FIG. 1.

In accordance with one embodiment, the leg support frame 7 may be configured as a bracket comprising a first and a second lateral holding fixture 30, 31, a bridging element 32 spaced apart from flexible membrane 8, supporting the first and second lateral holding fixtures 30 and 31, and a connecting element 33 for securing the leg support frame to the aid 1.

As illustrated in FIGS. 4, 5 and 15, 16 each of the first and a second lateral holding fixtures 30, 31 comprises a longitudinal slot 34, 35 configured for receiving the first and the second lateral support elements 22 and 23, respectively, in order to secure the flexible membrane 8 to the leg support frame 7.

The slots 34, 35 may be precisely tailored to accommodate the lateral support elements 22, 23 with the respective stoppers 24, 25. The slots 34, 35 and the lateral support elements 22, 23 have a complementary shape, so that they join to provide a rigid and load bearing construction.

The bridging element 32 supports the first and second lateral holding fixtures 30, 31, Moreover, the bridging element 32, which may have a U or C shaped configuration, together with the holding fixtures 30, 31 defines a membrane deformation space (S), permitting said membrane 8 to flex without contacting or only minimally contacting with any constructional elements of the leg support frame 7.

In an exemplary embodiment shown in FIGS. 4 and 17-20 the bridging element 32 has a curved shape. However, other frame forms may also be applied, which enable the membrane 8 to be configured as a freestanding sheet attached only at its lateral edges 26, 27, in such manner that no component of the frame assembly 7 is disposed closely behind or contacts the operative side of the membrane 8 during use.

With reference to FIG. 4, the leg support frame 7 optionally further comprises attachment points or attachment elements 36 and 37 on the first and second lateral holding fixtures 30, 31 for mounting a lower leg strap 9. In one embodiment, leg strap 9 is integral with, forms part of or is attached to leg support frame 7 and/or membrane 8. In one embodiment, leg strap 9 may be detachably coupled to leg support frame 7 and/or membrane 8 via fastening elements that may be removably connected to attachment points 36 and 37. In an exemplary embodiment, attachment points 36 and 37 are configured as laches, hooks, knobs, snaps, etc. and leg strap 9 may have corresponding strap holes, openings, snaps or fasteners for coupling to attachment points 36, 37. As shown in the exemplary embodiment of FIGS. 6 and 20, the attachment points 36, 37 may be positioned along opposing sides of frame 7 in a different plane than the length of leg strap 9 when coupled to frame 7 so that leg strap 9 may be securely hooked, attached and otherwise coupled to the fasteners elements of attachment points 36, 37.

In the exemplary embodiment shown in FIGS. 1, 6, 9-11 as well as 14-15 and 17-18 the lower leg strap 9 is attached to the frame 7 below the flexible supporting membrane 8 for securing the patient's legs in direct proximity of this membrane to prevent both sideways movements of the feet during a sit-to-stand movement.

Figure 13:
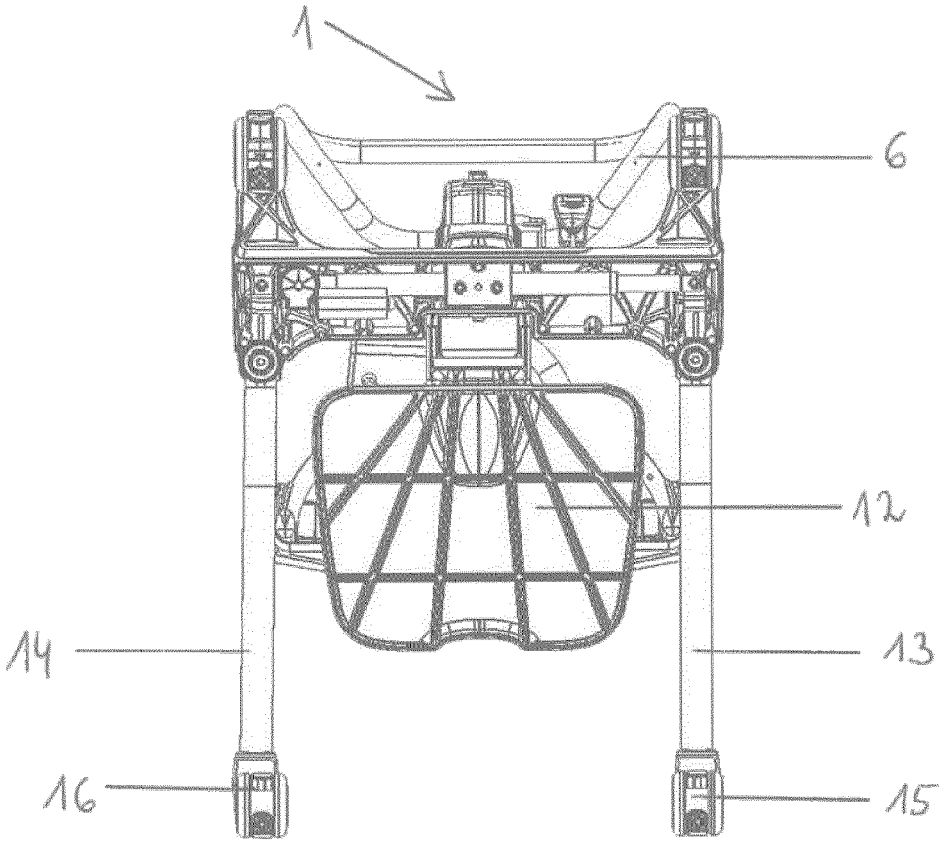
FIG. 13 is a view of the mobile standing and raising aid of FIGS. 1 and 7-12 showing in particular a foot plate.
Figure 14:
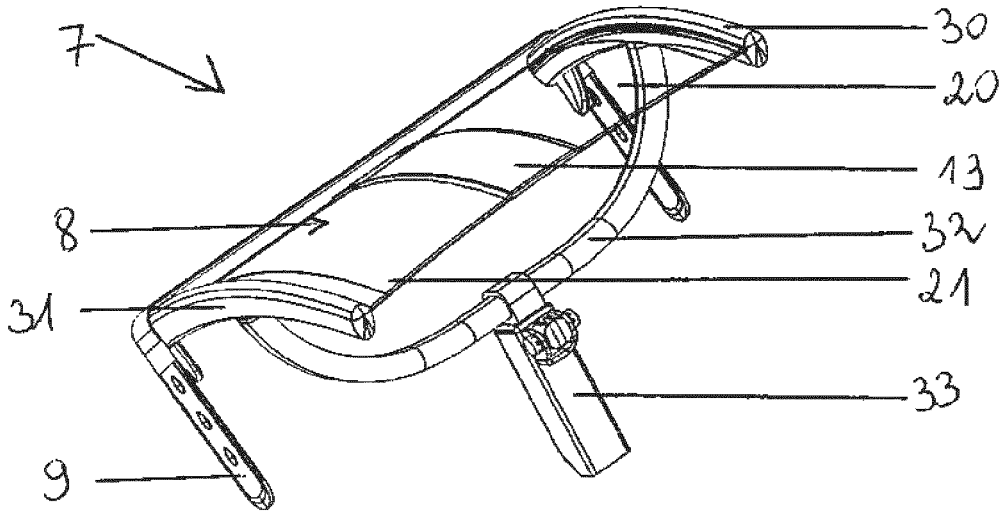
FIG. 14 is a perspective view of the leg support frame configured to hold the flexible supporting membrane of FIGS. 2-3.
Figure 15:
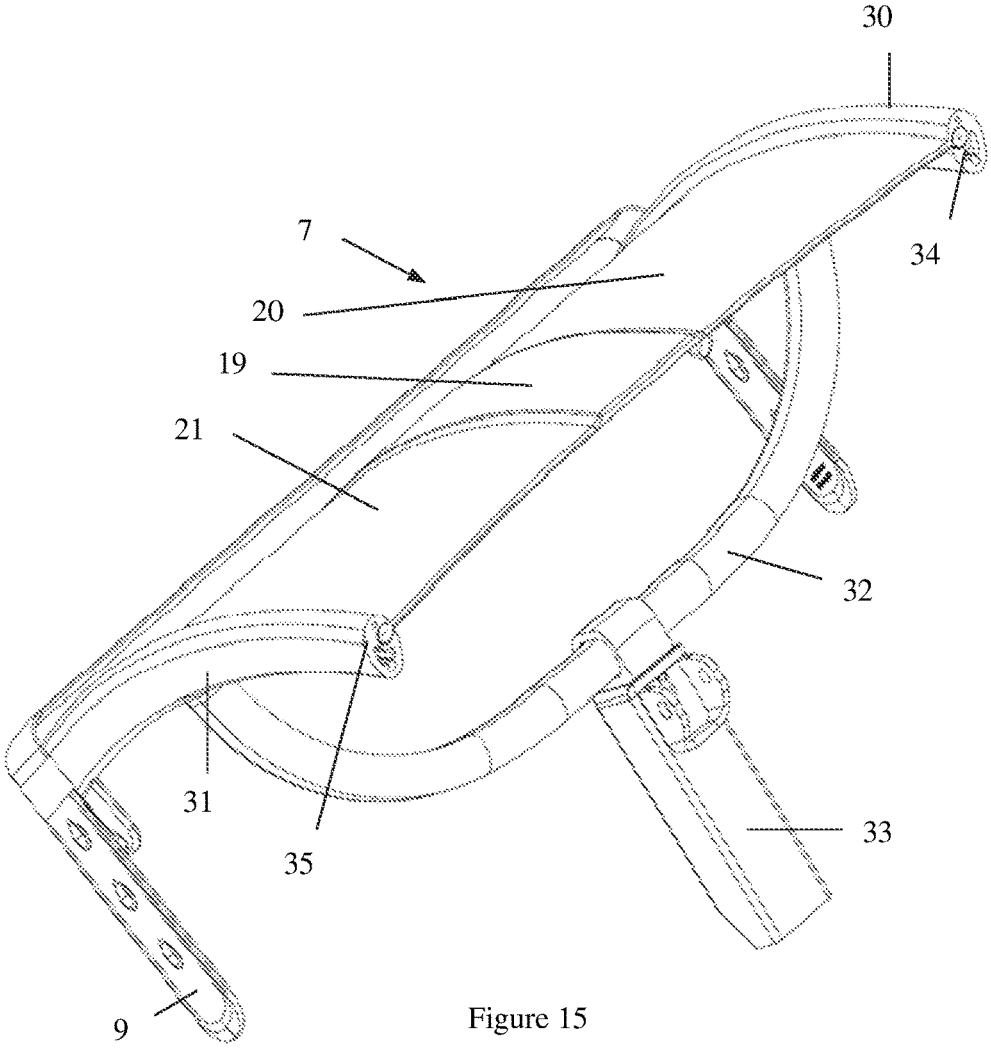
FIG. 15 is a cross-sectional view of a lateral holding fixture of the leg support frame of FIG. 14, showing a lateral support element of the flexible supporting membrane inserted into a slot within said lateral holding fixture.
Figure 16:
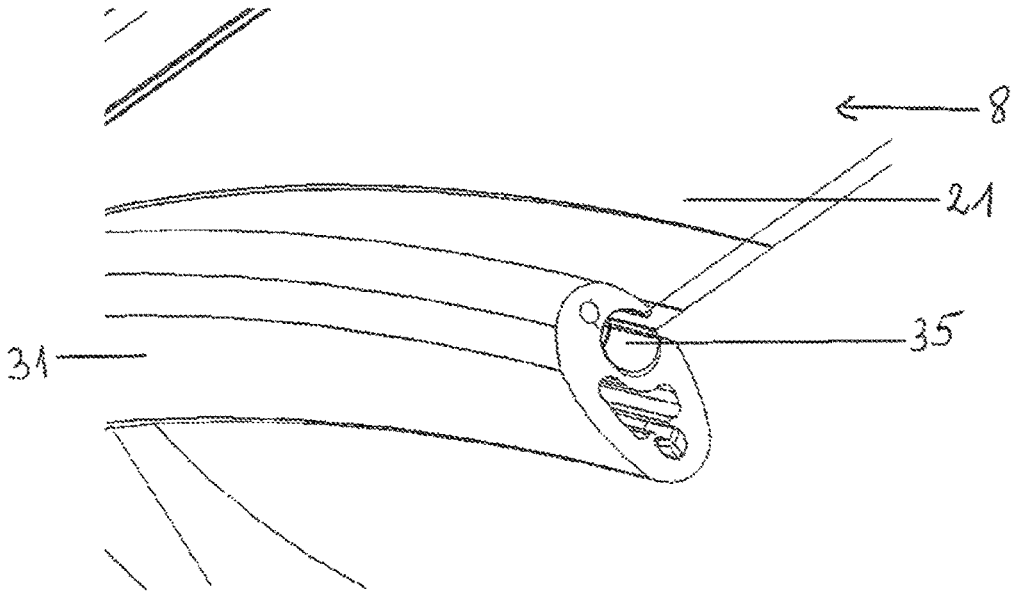
FIG. 16 shows an enlarged cross-sectional view of the lateral holding fixture of FIG. 15.
Figure 17:
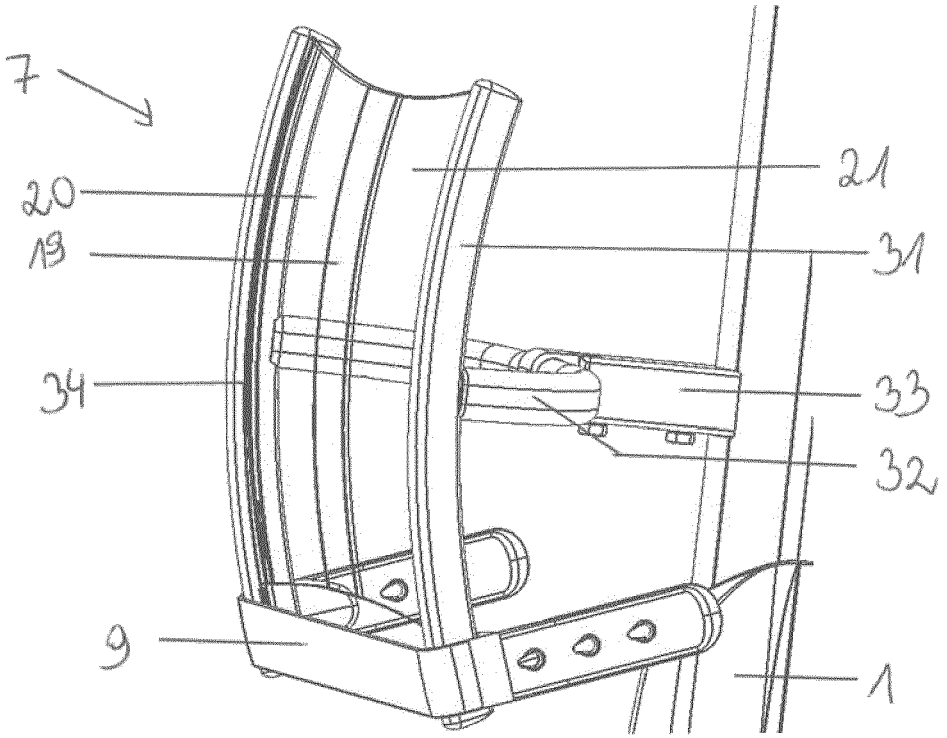
FIGS. 17 and 18 show perspective views of the leg support frame of FIG. 14 configured to hold the flexible supporting membrane and a lower leg strap.
Figure 18:
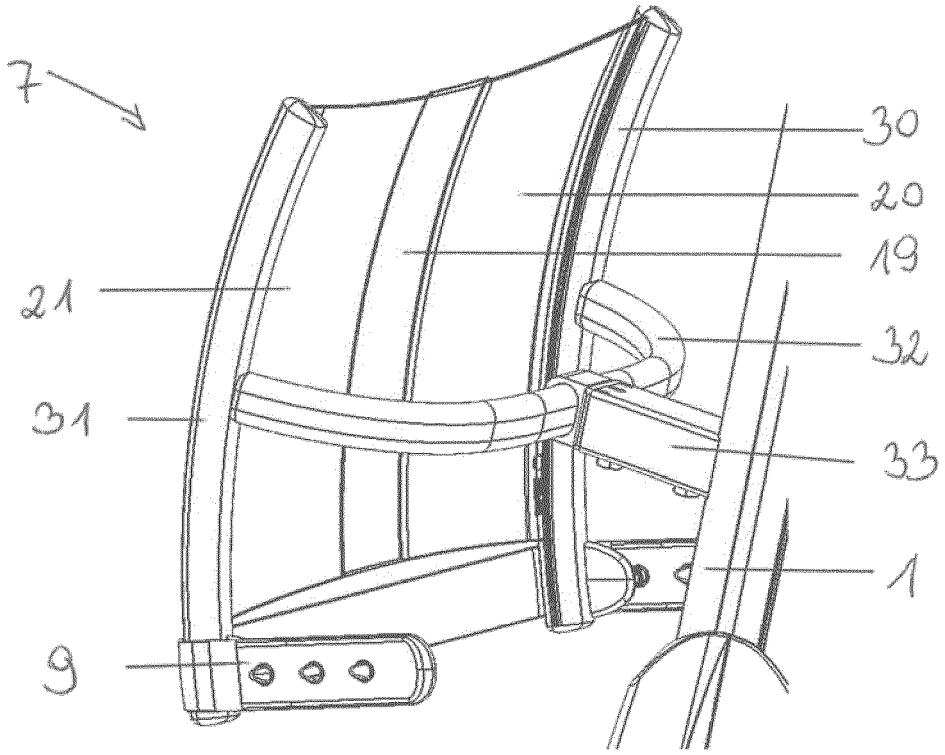
Figure 19:
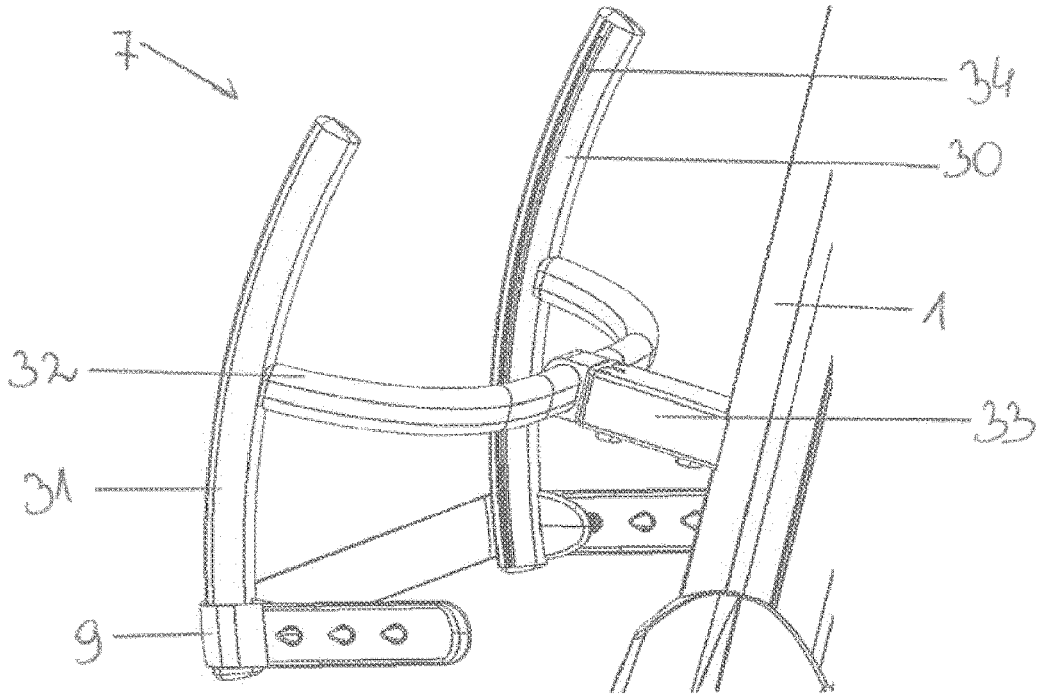
FIG. 19 is a perspective view of the lower leg strap attached to the leg support frame of FIGS. 17 and 18.
Figure 20:
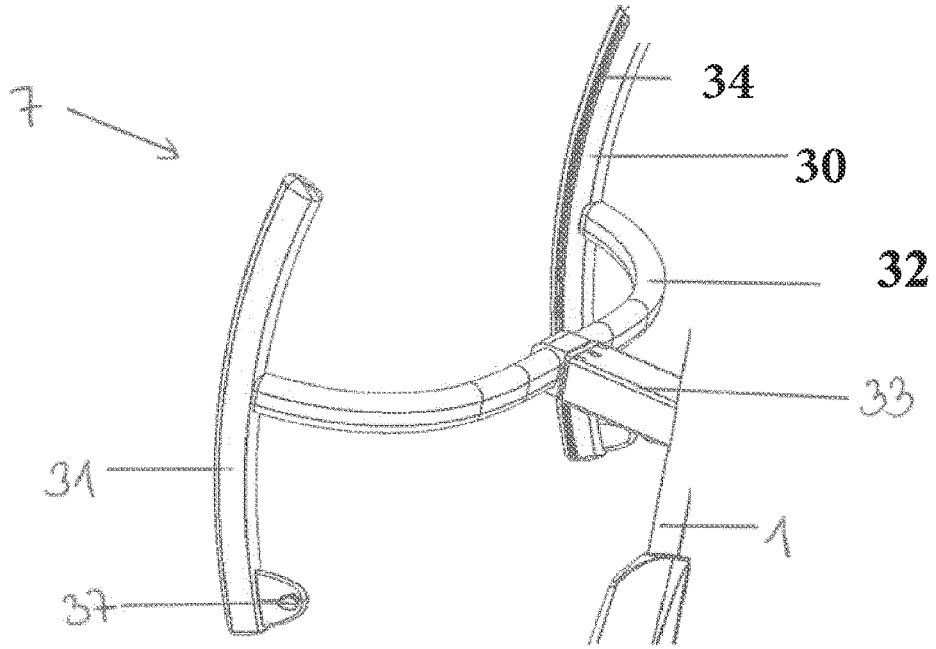
FIG. 20 is a perspective view of the leg support frame of FIGS. 17-18 showing an attachment point on the lateral holding fixture for mounting the lower leg strap of FIG. 19.

During use, the strap 9 may be adjustably placed against the lower part of the patient's calves to prevent slippage of the patient's feet from the foot plate 12 of FIGS. 6 and 13. In one embodiment, the length, tautness or connection of leg support frame 7 relative to attachment points 36, 37 can be adjusted to ensure comfortable, customized and secure attachment customized for each patient. For example, multiple attachment points 36, 37 on either side of frame 7 or member 8 and/or multiple fastening elements of leg strap 9 may be present to allow for adjustment of leg strap 9 relative to frame 7 and/or membrane 8.

The lower leg strap 9 is made from a flexible and stretchable material, such as silicone, so that it can distribute forces more equally on the patient's legs. Moreover, it has no sharp edges that may cut the skin. In addition, the leg strap 9 may be made of a wipeable or washable material.

The lower leg strap 9 may be stored on the aid 1. It can be placed and stretched just below the flexible supporting membrane 8, so that it does not get into the way when not used.

In an exemplary embodiment, the leg strap 9 may be configured as a belt that can be attached to the leg support frame 7 either by a buckle, with stops on the belt that prevents it from sliding or with holes that go into a knob.

FIG. 6 is a perspective view showing the position of the patient's knees and lower legs with respect to the flexible supporting membrane 8 during a sit-to-stand movement using the mobile standing and raising aid 1 of FIG. 1. The membrane 8 is sized to support the patient's knees and entire shins and is attached to the lateral support frame 7, so that it can take up the force exerted by the patient's legs during this movement and stretch to provide a comfortable support.

It will now be illustrated by way of example, and in particular with reference to FIGS. 1 and 6, how the described mobile standing and raising aid 1 can be used.

Initially, the patient is in a sitting position and the aid 1 is moved in front of the patient. The patient's feet are positioned on the foot plate 12. The patient's knees usually point straight ahead and the patient's shins can contact the surface of the flexible membrane 8. The lower leg strap 9 is tied around the patient's lower calves. The leg strap 9 helps to reduce the chance of slippage of the patient 38.

A sling 40 having one end attached to an attachment point 11 of the lifting arm 4 is placed around the patient's upper body as indicated in FIG. 6 and the other end of the sling 40 is then attached to the attachment point 11 of the lifting arm 4. Alternatively, both ends of the sling 40 can be loose and they can be attached to the respective attachment point 11 after the sling 40 has been placed around the patient 38. The sling 40 helps to secure the patient 38 to the aid 1 and provides support for the patient during a lift. Furthermore, the sling 40 helps to reduce the risk of the patient 38 falling down from the foot plate 12.

By the above described steps the patient can be safely fixed to the aid 1. The described steps can, however, be carried out in another sequence.

Figure 10:
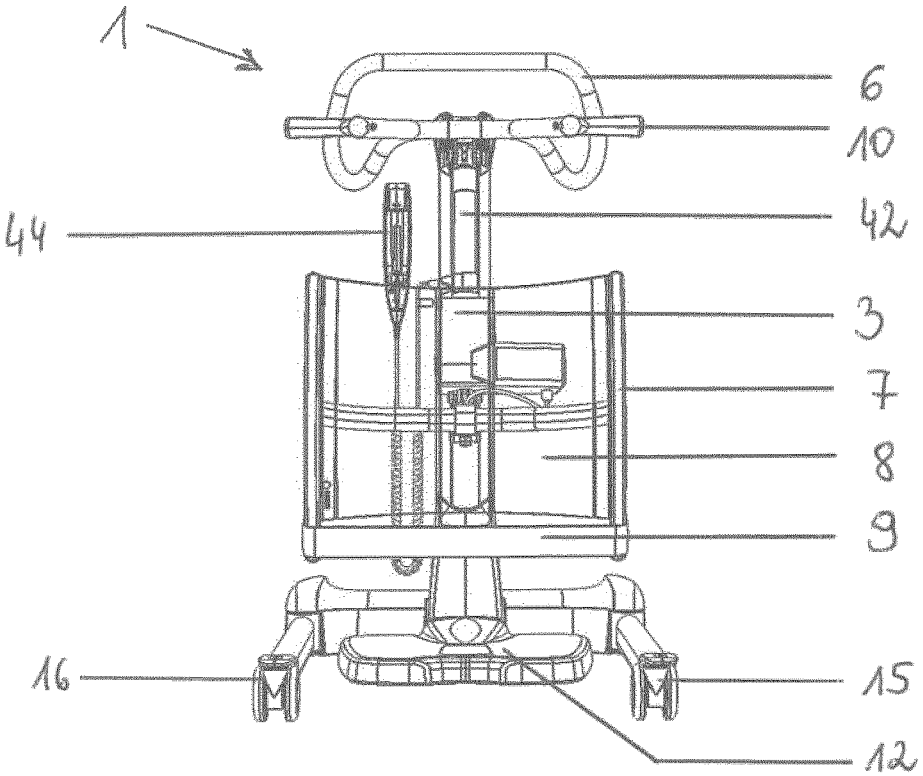
FIG. 10 is a front view of the mobile standing and raising aid of FIGS. 1 and 7-9.
Figure 11:
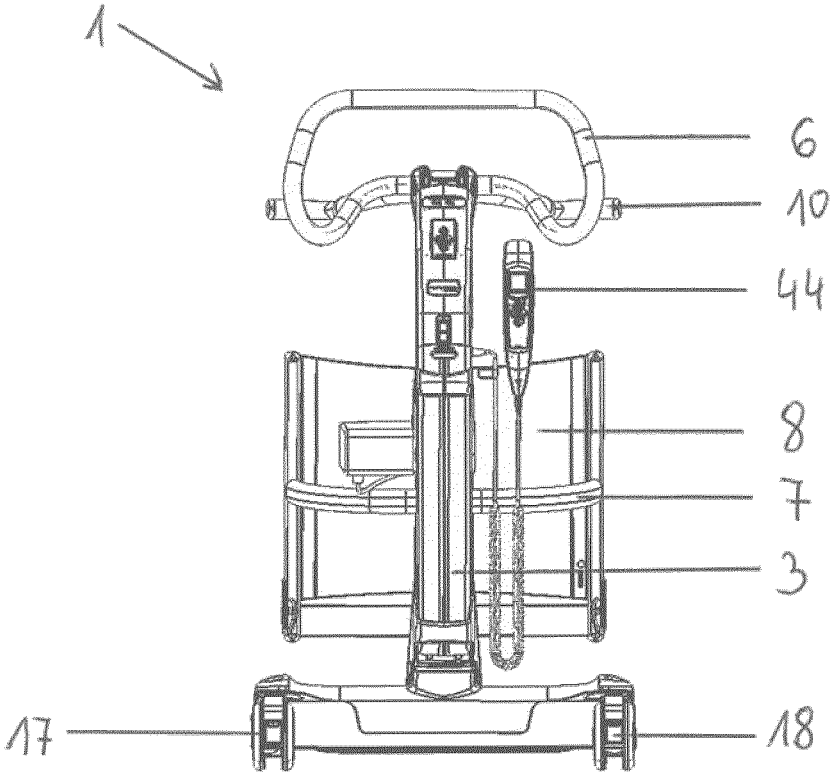
FIG. 11 is a rear view of the mobile standing and raising aid of FIGS. 1 and 7-10.
Figure 12:
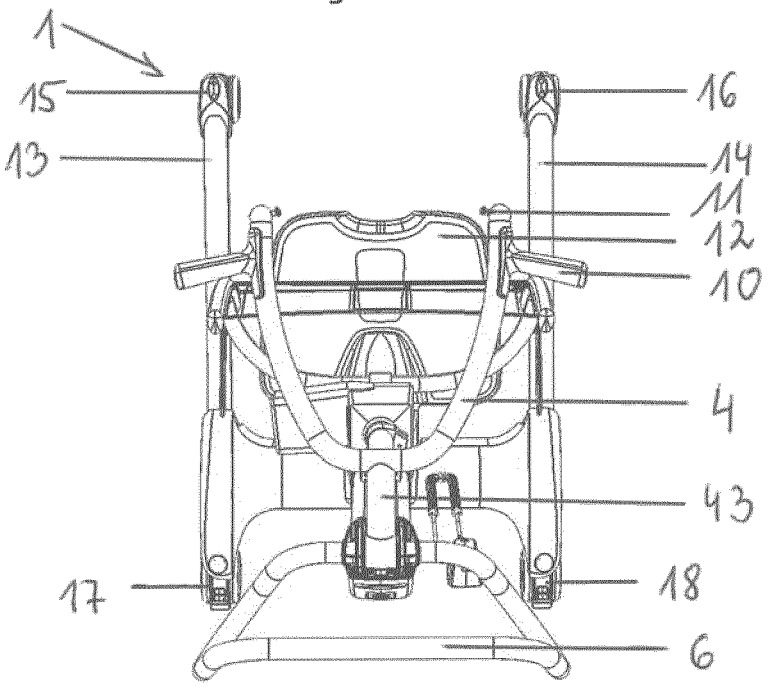
FIG. 12 is an top view of the mobile standing and raising aid of FIGS. 1 and 7-11.

The actuator 5, which may be a DC motor, comprises an extendable cylinder 41 that can extend and retract within an outer cylinder 42 as commanded by a controller 44 as shown in FIGS. 10 and 11. The upper end of the extendable cylinder 41 is pivotally coupled to a rod 43 as shown in FIG. 6. The rod 43 interconnects the mast 3 and the lifting arm 4. The rod 43 and the lifting arm 4 may be made of a single piece or of separate pieces. As shown in FIGS. 1 and 6, one end of the rod 43 is fixedly connected to the lifting arm 4 while the other end is pivotally coupled to the mast 3, thereby defining a pivot axis 48 for an arc movement of the lifting arm 4.

The actuator 5, when activated, causes an upward movement of the extendable cylinder 41 that causes an upward arc movement of the lifting arm 4. This brings the patient from the sitting position to a standing position. FIG. 6 shows an intermediate position in the course of the sit to stand movement.

During the lifting procedure, the sling 40 assists in lifting the patient 38 to the standing position. The aid 1 is also advantageous as it can help the patient 38 to slowly extend both legs during the stand up procedure. Furthermore, the flexible supporting membrane 8 can stretch in the peripheral sections 20, 21 based on the pressure applied by the knees, thus enabling the patient 38 to put the head over the toes to follow a natural sit-to-stand movement pattern. Upon being raised, the patient 38 may be transferred comfortably on the aid 1 by a caregiver 39 positioned behind the aid 1. By reversing the movement of the extendable cylinder 41, a downward arc movement of the lifting arm 4 can be initiated and the patient 38 can be brought back into the sitting position.

Summarizing, the present mobile patient standing and raising aid has, in particular, the following advantages:

With its single flexible membrane 8, which features a central knee separating section 19, a patient can be raised securely and comfortably. Also, the patient can participate in the raising movement by pushing on her legs.

Thanks to the membrane's flexibility, the patient can put her head over her toes when standing up, which greatly facilitates the procedure.

The flexible membrane is a "one fits all" element, which is suitable for a wide range of patient sizes and weights, without any need for any height and width adjustment. This is a clear advantage compared to prior solutions having two adjustable knee pads.

Although the disclosure has been described in detail for the purpose of illustration based on what is currently considered to be the most practical and exemplary embodiments, it is to be understood that such detail is solely for that purpose and that the invention is not limited to the disclosed embodiments, but, on the contrary, is intended to cover modifications and equivalent ranges that are within the spirit and scope of the appended claims. For example, it is to be understood that the present disclosure contemplates, to the extent possible, one or more features of any embodiment can be combined with one or more features of any other embodiment.

The invention claimed is:

1. A flexible supporting membrane for positioning and supporting knees and lower legs of a patient being lifted by a mobile standing and raising aid, wherein the flexible supporting membrane is made from a stretchable material formed into a sheet that adjusts itself based on pressure applied by the knees of the patient; the membrane being shaped to cover the knees and shins of the patient; the flexible supporting membrane comprising:

a top edge configured to be provided in a vicinity of the knees of the patient when in use;

a bottom edge configured to be provided in a vicinity of ankles of the patient when in use;

a first and second lateral edge extending between the bottom edge and the top edge;

a central section; and two peripheral sections adjacent to the central section, the two peripheral sections extending along the direction defined by the lateral edges between the top edge and the bottom edge of the sheet, wherein the peripheral sections are adapted for each supporting one of the two knees of the patient by yielding to pressure exerted by the knees and thus forming a knee cradling depression, and wherein the flexible supporting membrane has a higher elastic modulus in the central section than the two adjacent peripheral sections, such that the central section is stiffer than the two adjacent peripheral sections, such that during use of the flexible supporting membrane the central section deforms less than the peripheral sections and is configured to act as a barrier keeping the knees separated from each other in each respective depression.

2. The flexible supporting membrane according to claim 1, wherein the thickness of the membrane increases gradually and uniformly from the bottom edge to the top edge.

3. The flexible supporting membrane according to claim 1, wherein the membrane is formed from silicone.

4. The flexible supporting membrane according to claim 1, wherein the membrane is formed from polyurethane, thermoplastic polyurethane (TPU), a thermoplastic elastomer (TPE), or rubber material.

5. The flexible supporting membrane of claim 1, further comprising:

a first and a second lateral support element for attaching the flexible supporting membrane to a leg support frame, wherein the first lateral support element is attached to the first lateral edge; and the second lateral support element is attached to the second lateral edge; and the first and the second lateral support elements each comprise a radially projecting stopper preventing the membrane from sliding down when attached to the leg support frame.

6. The flexible supporting membrane of claim 5, wherein the stopper of the first lateral support element and the stopper of the second lateral support element have different geometries to prevent improper alignment of the membrane during attachment to the leg support frame.

7. A leg support frame, comprising:

the flexible supporting membrane of claim 5;

a first and a second lateral holding fixture each comprising a longitudinal slot for receiving the first and the second lateral support elements, respectively, for securing the flexible membrane to the leg support frame;

a bridging element supporting the first and second lateral holding fixtures; the bridging element and the holding fixtures defining a membrane deformation space permitting said membrane to flex without getting into contact with any constructional elements of the leg support frame; and a connecting element for securing the leg support frame to a mobile standing and raising aid.

8. The leg support frame of claim 7, further comprising a lower leg strap attached to the leg support frame below the flexible supporting membrane and made from a flexible and stretchable material, said lower leg strap for securing the lower legs of the patient in direct proximity of the flexible supporting membrane to prevent both sideways movements of feet of the patient with respect to said membrane.

9. The leg support frame of claim 8, wherein the lower leg strap is formed from silicone, polyurethane, thermoplastic polyurethane (TPU), a thermoplastic elastomer (TPE), or rubber material.

10. The leg support frame of claim 8, wherein said lower leg strap is mounted to an attachment point on either side of the leg support frame.

11. A mobile patient standing and raising aid comprising:

a base comprising a horizontal footplate;

a mast extending upwardly from the base and comprising a maneuvering handle; a lifting arm pivotally coupled to the mast for arc movement between a lowered and a raised position of the aid; the lifting arm comprising a sling attachment point and a patient handle;

an actuator located between the mast and the lifting arm for moving the lifting arm; and further comprising:

the leg support frame of claim 7.

12. A method of lifting a patient from a sitting position to a standing position using a mobile patient standing and raising aid according to claim 11, the method comprising the steps of:

securing the patient to the mobile patient standing and raising aid, actuating the actuator to cause the arc movement of the lifting arm from the lowered to the raised position of the lifting arm, thereby bringing the patient from the sitting position to the standing position.

13. The flexible supporting membrane of claim 1, wherein each peripheral section has a visual indicator to facilitate correct placement of the patient's knees.

14. The flexible supporting membrane of claim 1, wherein the higher stiffness of the central section is due to a higher thickness of the central section compared to the peripheral sections.

15. A mobile patient standing and raising aid comprising:

a base comprising a horizontal footplate;

a mast extending upwardly from the base and comprising a maneuvering handle;

a lifting arm pivotally coupled to the mast for arc movement between a lowered and a raised position of the aid; the lifting arm comprising a sling attachment point and a patient handle;

a flexible supporting membrane comprising: a top edge configured to be provided in a vicinity of knees of the patient when in use; a bottom edge configured to be provided in a vicinity of ankles of the patient when in use; a first and second lateral edge extending between the bottom edge and the top edge; and a central and two peripheral sections extending along the direction defined by the lateral edges between the top edge and the bottom edge of a sheet, wherein the peripheral sections are adapted for each supporting one of the two knees of the patient by yielding to pressure exerted by the knees and thus forming a knee cradling depression, and wherein the flexible supporting membrane has a higher elastic modulus in the central section than the two adjacent peripheral sections, such that the central section is stiffer than the two adjacent peripheral sections, such that during use of the flexible supporting membrane the central section deforms less than the peripheral sections and is configured to act as a barrier keeping the knees separated from each other in each respective depression; and a strap made from a flexible and stretchable material, the strap for securing the lower legs of the patient in direct proximity of the flexible supporting membrane to prevent both sideways movements of feet of the patient with respect to said membrane.

* * * * *